US009779665B2

(12) United States Patent
Song et al.

(10) Patent No.: US 9,779,665 B2
(45) Date of Patent: Oct. 3, 2017

(54) GATE DRIVER FOR DISPLAY DEVICE AND DISPLAY DEVICE INCLUDING THE SAME

(71) Applicant: Samsung Display Co., Ltd., Yongin-si, Gyeonggi-do (KR)

(72) Inventors: Jun-Yong Song, Hwaseong-si (KR); Oh-Jo Kwon, Suwon-si (KR); Ji-Woong Kim, Suwon-si (KR); Choong-Sun Shin, Yongin-si (KR); Hee-Sun Ahn, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 13 days.

(21) Appl. No.: 14/836,796

(22) Filed: Aug. 26, 2015

(65) Prior Publication Data

US 2016/0240144 A1 Aug. 18, 2016

(30) Foreign Application Priority Data

Feb. 12, 2015 (KR) ..... 10-2015-0021395

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01); *G09G 2320/0233* (2013.01); *G09G 2320/0285* (2013.01); *G09G 2320/0295* (2013.01); *G09G 2320/045* (2013.01)

(58) Field of Classification Search
None
See application file for complete search history.

(56) References Cited

U.S. PATENT DOCUMENTS 7,755,578 B2 * 7/2010 Park ..... G09G 3/3291 315/169.3
7,852,286 B2 * 12/2010 Choi ..... G09G 3/3233 345/30
8,269,803 B2 * 9/2012 Yoo ..... G09G 3/3233 345/690
8,354,984 B2 * 1/2013 Choi ..... G09G 3/3233 345/77

(Continued)

FOREIGN PATENT DOCUMENTS

KR 10-2006-0114458 A 11/2006
KR 10-2011-0124655 A 11/2011

(Continued)

*Primary Examiner* — Chad Dicke
(74) *Attorney, Agent, or Firm* — Knobbe Martens Olson & Bear LLP

(57) ABSTRACT

A gate driver for a display device and a display device including the same are disclosed. In one aspect, the gate driver includes first through N-th scan drivers configured to respectively output first through N-th scan signals, where N is an integer greater than 1. The gate driver also includes first through N-th sensing drivers configured to respectively output first through N-th sensing signals, wherein an M-th one of the first through N-th sensing drivers is configured to activate an M-th one of the first through N-th sensing signals K times during an active period of an (M+1)-th one of the first through N-th scan signals, where M is an integer greater than 0 and less than N and K is an integer greater than 1.

20 Claims, 8 Drawing Sheets

(56) References Cited

U.S. PATENT DOCUMENTS 8,405,582 B2 * 3/2013 Kim ..... G09G 3/3233 315/169.3
8,558,766 B2 * 10/2013 Kwon ..... G09G 3/3233 315/169.3
9,093,024 B2 * 7/2015 Handa ..... G09G 3/3233
9,171,499 B2 * 10/2015 Park ..... G09G 3/3225
2002/0101395 A1 * 8/2002 Inukai ..... G09G 3/3258 345/83
2005/0052350 A1 * 3/2005 Mizukoshi ..... G09G 3/3233 345/55
2005/0184933 A1 * 8/2005 Tomohara ..... G09G 3/3208 345/76
2006/0022907 A1 * 2/2006 Uchino ..... G09G 3/3233 345/76
2006/0049768 A1 * 3/2006 Yang ..... H05B 33/0896 315/150
2007/0024543 A1 * 2/2007 Chung ..... G09G 3/3233 345/76
2008/0001545 A1 * 1/2008 Uchino ..... G09G 3/3233 315/175
2008/0143264 A1 * 6/2008 Minami ..... G09G 3/3233 315/169.3
2008/0297449 A1 * 12/2008 Yamashita ..... G09G 3/3233 345/76
2010/0053041 A1 * 3/2010 Abe ..... G09G 3/325 345/76
2010/0073335 A1 * 3/2010 Min ..... G09G 3/3233 345/204
2011/0012819 A1 * 1/2011 Ryu ..... G09G 3/3233 345/82
2011/0210958 A1 * 9/2011 Yoo ..... G09G 3/325 345/214
2011/0279436 A1 * 11/2011 Komiya ..... G09G 3/3233 345/212
2011/0279437 A1 * 11/2011 Komiya ..... G09G 3/3233 345/212
2013/0141316 A1 * 6/2013 Lee ..... G09G 3/3266 345/76
2013/0257831 A1 * 10/2013 Kim ..... G09G 3/3266 345/205
2014/0204071 A1 * 7/2014 Kwon ..... G09G 3/3291 345/212
2015/0145754 A1 * 5/2015 Yang ..... G09G 3/3283 345/76
2016/0042690 A1 * 2/2016 Chang ..... G09G 3/3258 345/212
2016/0078813 A1 * 3/2016 Mizukoshi ..... G09G 3/3233 345/76
2016/0141352 A1 * 5/2016 Sung ..... G11C 19/28 257/40
2016/0163265 A1 * 6/2016 Yang ..... G09G 3/3233 345/690
2016/0189627 A1 * 6/2016 Park ..... G09G 3/3291 345/78

FOREIGN PATENT DOCUMENTS

KR 10-2011-0124656 A 11/2011
KR 10-2014-0081450 A 7/2014

* cited by examiner

GATE DRIVER FOR DISPLAY DEVICE AND DISPLAY DEVICE INCLUDING THE SAME

CROSS-REFERENCE TO RELATED APPLICATION(S)

This application claims priority under 35 USC §119 to Korean Patent Applications No. 10-2015-0021395, filed on Feb. 12, 2015 in the Korean Intellectual Property Office (KIPO), the contents of which are incorporated herein in its entirety by reference.

BACKGROUND

Field

The described technology generally relates to a gate driver for a display device and a display device including the same.

Description of the Related Technology

In an organic light-emitting diode (OLED) display, an OLED in each pixel degrades over time, and thus, pixel luminance can dim. To compensate for this luminance degradation, a deterioration sensing technique has been developed which measures a current flowing through the OLED by applying a predetermined voltage to the OLED.

SUMMARY OF CERTAIN INVENTIVE ASPECTS

One inventive aspect relates to a gate driver that can consecutively output a sensing signal a plurality of times to each scan line such that deterioration measurements for pixels of each row are iteratively performed the plurality of times.

Another aspect is a display device that can improve accuracy of measurement of a deterioration of an OLED.

Another aspect is a gate driver of a display device including first through N-th scan driving units configured to respectively output first through N-th scan signals, and first through N-th sensing driving units configured to respectively output first through N-th sensing signals, where N is an integer greater than 1. An M-th one of the first through N-th sensing driving units activates an M-th one of the first through N-th sensing signals a plurality of times during an active period of an (M+1)-th one of the first through N-th scan signals, where M is an integer greater than 0 and less than N.

In some example embodiments, the gate driver is an embedded gate driver that is embedded in a display panel of the display device.

In some example embodiments, the M-th one of the first through N-th sensing driving units include a first transistor configured to output a sensing clock signal as the M-th one of the first through N-th sensing signals during an active period of an (M+1)-th carry signal in response to the (M+1)-th carry signal output from an (M+1)-th one of the first through N-th scan driving units, and a second transistor configured to output a power supply voltage as the M-th one of the first through N-th sensing signals during an active period of an (M+2)-th carry signal in response to the (M+2)-th carry signal output from an (M+2)-th one of the first through N-th scan driving units.

In some example embodiments, the sensing clock signal has a plurality of pulses within the active period of the (M+1)-th carry signal.

In some example embodiments, the sensing clock signal has a clock-active period and a clock-inactive period during the active period of the (M+1)-th carry signal, and the sensing clock signal has a plurality of pulses within the clock-active period.

In some example embodiments, the first transistor has a first PMOS transistor having a first terminal receiving the sensing clock signal, a second terminal coupled to an output node of the M-th one of the first through N-th sensing driving units, and a first gate terminal receiving the (M+1)-th carry signal, and the second transistor has a second PMOS transistor having a third terminal coupled to the output node of the M-th one of the first through N-th sensing driving units, a fourth terminal receiving the power supply voltage, and a second gate terminal receiving the (M+2)-th carry signal.

In some example embodiments, the M-th one of the first through N-th sensing driving units include a first transistor configured to output a sensing clock signal as the M-th one of the first through N-th sensing signals during an active period of an (M+1)-th carry signal in response to the (M+1)-th carry signal output from an (M+1)-th one of the first through N-th scan driving units, and a second transistor configured to output a power supply voltage as the M-th one of the first through N-th sensing signals during an inactive period of the (M+1)-th carry signal in response to the (M+1)-th carry signal.

In some example embodiments, the first transistor is a PMOS transistor having a first terminal receiving the sensing clock signal, a second terminal coupled to an output node of the M-th one of the first through N-th sensing driving units, and a first gate terminal receiving the (M+1)-th carry signal, and the second transistor is an NMOS transistor having a third terminal coupled to the output node of the M-th one of the first through N-th sensing driving units, a fourth terminal receiving the power supply voltage, and a second gate terminal receiving the (M+1)-th carry signal.

In some example embodiments, the M-th one of the first through N-th sensing driving units include a first transistor configured to output a sensing clock signal as the M-th one of the first through N-th sensing signals during an active period of an (M+1)-th carry signal in response to the (M+1)-th carry signal output from an (M+1)-th one of the first through N-th scan driving units, an inverter configured to generate an inverted (M+1)-th carry signal by inverting the (M+1)-th carry signal, and a second transistor configured to output a power supply voltage as the M-th one of the first through N-th sensing signals during an inactive period of the (M+1)-th carry signal in response to the inverted (M+1)-th carry signal.

In some example embodiments, the first transistor is a first PMOS transistor having a first terminal receiving the sensing clock signal, a second terminal coupled to an output node of the M-th one of the first through N-th sensing driving units, and a first gate terminal receiving the (M+1)-th carry signal, and the second transistor is a second PMOS transistor having a third terminal coupled to the output node of the M-th one of the first through N-th sensing driving units, a fourth terminal receiving the power supply voltage, and a second gate terminal receiving the inverted (M+1)-th carry signal.

In some example embodiments, the first through N-th scan driving units and the first through N-th sensing driving units are formed on a peripheral region of a display panel included in the display device.

In some example embodiments, the first through N-th scan driving units and the first through N-th sensing driving units are alternately disposed.

In some example embodiments, the first through N-th scan driving units are formed on a first peripheral region located in a first direction from a display region of a display panel included in the display device, and the first through N-th sensing driving units can be formed on a second peripheral region located in a second direction opposite to the first direction from the display region of the display panel.

In some example embodiments, the first through N-th sensing driving units output the first through N-th sensing signals in a sensing mode.

Another aspect is a display device including a display panel including a plurality of pixels, a source driver configured to provide data signals to the pixels, and a gate driver configured to provide first through N-th scan signals and first through N-th sensing signals to the pixels, where N is an integer greater than 1. The gate driver includes first through N-th scan driving units configured to respectively output the first through N-th scan signals through first through N-th scan lines, and first through N-th sensing driving units configured to respectively output the first through N-th sensing signals through first through N-th sensing lines. An M-th one of the first through N-th sensing driving units activates an M-th one of the first through N-th sensing signals a plurality of times during an active period of an (M+1)-th one of the first through N-th scan signals, where M is an integer greater than 0 and less than N.

In some example embodiments, the gate driver is an embedded gate driver that is embedded in the display panel.

In some example embodiments, one of the pixels coupled to an M-th one of the first through N-th scan lines and an M-th one of the first through N-th sensing lines include a switching transistor configured to transfer a voltage applied to a data line in response to an M-th one of the first through N-th scan signals, a storage capacitor configured to store the voltage transferred by the switching transistor, a driving transistor configured to generate a driving current in response to the voltage stored in the storage capacitor, an organic light emitting diode configured to emit light in response to the driving current, and a sensing transistor configured to couple the data line to the organic light emitting diode in response to an M-th one of the first through N-th sensing signals.

In some example embodiments, in a sensing mode, a setup voltage is applied to the data line such that the setup voltage of the data line is applied to the organic light emitting diode through the sensing transistor, and a current flowing through the organic light emitting diode by the setup voltage is measured.

In some example embodiments, the M-th one of the first through N-th sensing signals are a plurality of pulses within the active period of the (M+1)-th one of the first through N-th scan signals, and the current flowing through the organic light emitting diode by the setup voltage is measured the plurality of times during the active period of the (M+1)-th one of the first through N-th scan signals in response to the plurality of pulses.

In some example embodiments, deterioration data representing a deterioration degree of the organic light emitting diode is generated based on an average of the current that is measured the plurality of times, and, in a normal operating mode, input image data for the one of the pixels is adjusted based on the deterioration data.

Another aspect is a gate driver for a display device, the gate driver comprising: first through N-th scan drivers configured to respectively output first through N-th scan signals, where N is an integer greater than 1; and first through N-th sensing drivers configured to respectively output first through N-th sensing signals, wherein an M-th one of the first through N-th sensing drivers is configured to activate an M-th one of the first through N-th sensing signals K times during an active period of an (M+1)-th one of the first through N-th scan signals, where M is an integer greater than 0 and less than N and K is an integer greater than 1.

In the above gate driver, the gate driver is embedded in a display panel of the display device.

In the above gate driver, the M-th sensing driver comprises: a first transistor configured to output a sensing clock signal as the M-th sensing signal during an active period of an (M+1)-th carry signal based on the (M+1)-th carry signal output from an (M+1)-th one of the first through N-th scan drivers; and a second transistor configured to output a power supply voltage as the M-th sensing signal during an active period of an (M+2)-th carry signal based on the (M+2)-th carry signal output from an (M+2)-th one of the first through N-th scan drivers.

In the above gate driver, the sensing clock signal includes a plurality of pulses within the active period of the (M+1)-th carry signal.

In the above gate driver, the sensing clock signal includes a clock-active period and a clock-inactive period during the active period of the (M+1)-th carry signal, wherein the sensing clock signal includes a plurality of pulses within the clock-active period.

In the above gate driver, the first transistor is a first PMOS transistor including a first terminal configured to receive the sensing clock signal, a second terminal electrically connected to an output node of the M-th sensing driver, and a first gate terminal configured to receive the (M+1)-th carry signal, wherein the second transistor is a second PMOS transistor including a third terminal electrically connected to the output node of the M-th sensing driver, a fourth terminal configured to receive the power supply voltage, and a second gate terminal configured to receive the (M+2)-th carry signal.

In the above gate driver, the M-th sensing driver comprises: a first transistor configured to output a sensing clock signal as the M-th sensing signal during an active period of an (M+1)-th carry signal based on the (M+1)-th carry signal output from an (M+1)-th one of the first through N-th scan drivers; and a second transistor configured to output a power supply voltage as the M-th sensing signal during an inactive period of the (M+1)-th carry signal based on the (M+1)-th carry signal.

In the above gate driver, the first transistor is a PMOS transistor including a first terminal configured to receive the sensing clock signal, a second terminal electrically connected to an output node of the M-th sensing driver, and a first gate terminal configured to receive the (M+1)-th carry signal, wherein the second transistor is an NMOS transistor including a third terminal electrically connected to the output node of the M-th sensing driver, a fourth terminal configured to receive the power supply voltage, and a second gate terminal configured to receive the (M+1)-th carry signal.

In the above gate driver, the M-th sensing driver comprises: a first transistor configured to output a sensing clock signal as the M-th sensing signal during an active period of an (M+1)-th carry signal based on the (M+1)-th carry signal output from an (M+1)-th one of the first through N-th scan drivers; an inverter configured invert the (M+1)-th carry signal so as to generate an inverted (M+1)-th carry signal; and a second transistor configured to output a power supply voltage as the M-th sensing signal during an inactive period of the (M+1)-th carry signal based on the inverted (M+1)-th carry signal.

In the above gate driver, the first transistor is a first PMOS transistor including a first terminal configured to receive the sensing clock signal, a second terminal electrically connected to an output node of the M-th sensing driver, and a first gate terminal configured to receive the (M+1)-th carry signal, wherein the second transistor is a second PMOS transistor including a third terminal electrically connected to the output node of the M-th sensing driver, a fourth terminal configured to receive the power supply voltage, and a second gate terminal configured to receive the inverted (M+1)-th carry signal.

In the above gate driver, the first through N-th scan drivers and the first through N-th sensing drivers are formed in a peripheral region of a display panel included in the display device.

In the above gate driver, the first through N-th scan drivers and the first through N-th sensing drivers are alternately formed.

In the above gate driver, the first through N-th scan drivers are formed in a first peripheral region located on a first side of a display region of a display panel included in the display device, wherein the first through N-th sensing drivers are formed in a second peripheral region located on a second side opposite to the first side in the display region.

In the above gate driver, the first through N-th sensing drivers are further configured to output the first through N-th sensing signals in a sensing mode.

Another aspect is a display device, comprising: a display panel including a plurality of pixels; a source driver configured to provide a plurality of data signals to the pixels; and a gate driver configured to provide first through N-th scan signals and first through N-th sensing signals to the pixels, where N is an integer greater than 1. The gate driver includes: first through N-th scan drivers configured to respectively output the first through N-th scan signals through first through N-th scan lines; and first through N-th sensing drivers configured to respectively output the first through N-th sensing signals through first through N-th sensing lines, wherein an M-th one of the first through N-th sensing drivers is further configured to activate an M-th one of the first through N-th sensing signals K times during an active period of an (M+1)-th one of the first through N-th scan signals, where M is an integer greater than 0 and less than N and K is an integer greater than 1.

In the above display device, the gate driver is embedded in the display panel.

In the above display device, the source driver is further configured to provide one of the data signals to the pixels as a voltage applied via a data line, wherein a selected one of the pixels electrically connected to an M-th one of the first through N-th scan lines and an M-th one of the first through N-th sensing lines includes: a switching transistor configured to transfer the applied voltage based on an M-th one of the first through N-th scan signals; a storage capacitor configured to store the transferred voltage; a driving transistor configured to generate a driving current based on the stored voltage; an organic light-emitting diode (OLED) configured to emit light based on the driving current; and a sensing transistor configured to electrically connect the data line to the OLED based on the M-th sensing signal.

In the above display device, in a sensing mode, the source driver is configured to apply a setup voltage to the data line such that the setup voltage of the data line is applied to the OLED through the sensing transistor so as to measure a current flowing through the OLED.

In the above display device, the M-th sensing signal includes a plurality of pulses within the active period of the (M+1)-th scan signal, wherein the current flowing through the OLED is further configured to be measured K times during the active period of the (M+1)-th scan signal.

The above display device further comprises a calculator configured to calculate an average current amount of the current measured K times, wherein the calculator is configured to generate deterioration data corresponding to a deterioration degree of the OLED based on the average current amount, and wherein, in a normal operating mode, the source driver is further configured to adjust the input image data for the selected pixel based on the deterioration data.

According to at least one of the disclosed embodiments, the gate driver and the display device consecutively activate the sensing signal applied to the pixels located at one row the plurality of times, and thus iteratively measure the deterioration of the OLEDs included in the pixels, thereby improving the accuracy of the deterioration measurement for the OLEDs.

Further, the gate driver and the display device according to example embodiments iteratively measure the deterioration of the OLEDs with respect to each row, thereby minimizing a size of a memory for storing measured data.

DETAILED DESCRIPTION OF CERTAIN INVENTIVE EMBODIMENTS

Figure 1:
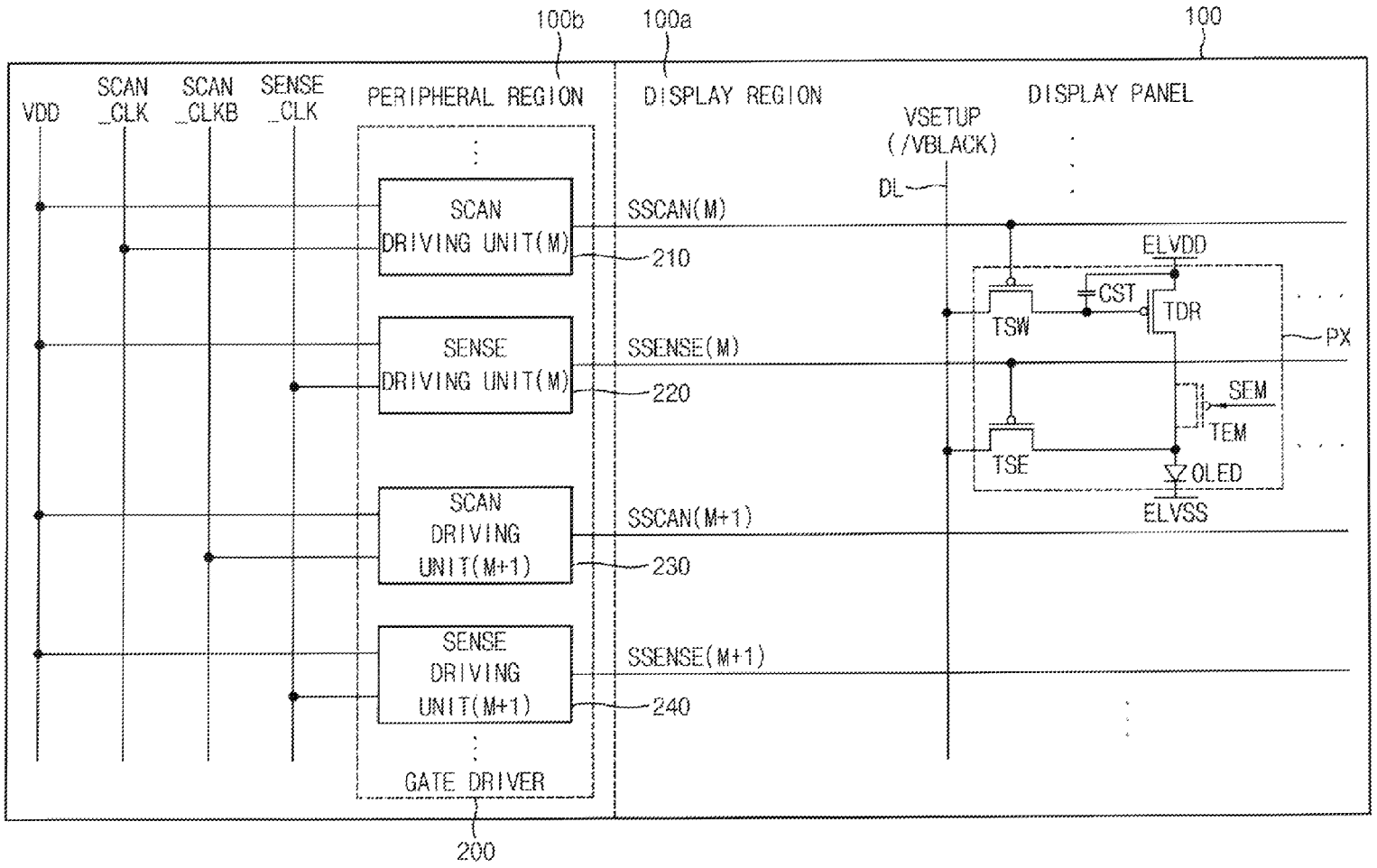
FIG. 1 is a diagram illustrating a display panel including a gate driver according to example embodiments.

In a typical method of sensing deterioration in OLEDs, the current flowing through the OLED is measured only once, and this can lead to an inaccurate determination of OLED quality.

The example embodiments are described more fully hereinafter with reference to the accompanying drawings. Like or similar reference numerals refer to like or similar elements throughout. In this disclosure, the term "substantially" includes the meanings of completely, almost completely or to any significant degree under some applications and in accordance with those skilled in the art. The term "connected" can include an electrical connection.

Referring to FIG. 1, a display panel 100 includes a display region 100*a* and a peripheral region 100*b*. In the display region 100*a* of the display panel 100, a plurality of pixels PX can be formed. The pixels PX can be arranged in a matrix having a plurality of rows and a plurality of columns. Each pixel PX can include a switching transistor TSW that transfers a voltage applied to a data line DL in response to a corresponding scan signal SSCAN(M) and SSCAN(M+1), a storage capacitor CST that stores the voltage transferred by the switching transistor TSW, a driving transistor TDR that generates a driving current in response to the voltage stored in the storage capacitor CST, an OLED that emits light in response to the driving current, and a sensing transistor that couples the data line DL to the OLED in response to a corresponding sensing signal SSENSE(M) and SSENSE (M+1). In some example embodiments, each pixel PX further includes an emission transistor TEM that selectively couples the driving transistor TDR to the OLED in response to an emission signal SEM. Depending on embodiments, certain elements may be removed from or additional elements may be added to the display panel 100 illustrated in FIG. 1. Furthermore, two or more elements may be combined into a single element, or a single element may be realized as multiple elements. This applies to the remaining apparatus embodiments.

In the peripheral region 100*b*, a gate driver 200 provides first through N-th scan signals SSCAN(M) and SSCAN(M+1) and first through N-th sensing signals SSENSE(M) and SSENSE(M+1) to the pixel PX, where N is an integer greater than 1. In some example embodiments, the gate driver 200 is not implemented as an integrated circuit, and is an embedded gate driver including transistors directly formed on the peripheral region 100*b*. That is, the gate driver 200 can be embedded in the display panel 100.

The gate driver 200 can provide the first through N-th scan signals SSCAN(M) and SSCAN(M+1) in a normal operating mode, and can provide the first through N-th sensing signals SSENSE(M) and SSENSE(M+1) and/or the first through N-th scan signals SSCAN(M) and SSCAN(M+1) in a sensing mode. The gate driver 200 can include first through N-th scan driving units or scan drivers 210 and 230 that respectively output the first through N-th scan signals SSCAN(M) and SSCAN(M+1), and first through N-th sensing driving units or sensing driving drivers 220 and 240 that respectively output the first through N-th sensing signals SSENSE(M) and SSENSE(M+1).

The first through N-th scan driving units 210 and 230 can sequentially activate the first through N-th scan signals SSCAN(M) and SSCAN(M+1) in response to a scan clock signal SCAN_CLK in the normal operating mode and/or the sensing mode. In some example embodiments, the first through N-th scan driving units 210 and 230 receive the scan clock signal SCAN_CLK and an inverted scan clock signal SCAN_CLKB. In this case, odd-numbered ones of the first through N-th scan driving units 210 and 230 can operate in response to the scan clock signal SCAN_CLK, and even-numbered ones of the first through N-th scan driving units 210 and 230 can operate in response to the inverted scan clock signal SCAN_CLKB. For example, a first scan driving unit activates a first scan signal while the scan clock signal has a low level, and then a second scan driving unit can activate a second scan signal in response to the first scan signal (or a first carry signal of the first scan driving unit) while the inverted scan clock signal SCAN_CLKB has the low level. Subsequently, a third scan driving unit can activate a third scan signal in response to the second scan signal (or a second carry signal of the second scan driving unit) while the scan clock signal SCAN_CLK has the low level.

The first through N-th sensing driving units 220 and 240 can respectively output the first through N-th sensing signals SSENSE(M) and SSENSE(M+1) in the sensing mode. Each sensing driving unit 220 and 240 can activate a corresponding sensing signal SSENSE(M) and SSENSE(M+1) a plurality of times in response to a sensing clock signal SENSE_CLK during an active period of a scan signal (or a carry signal) output from a scan driving unit of a next stage. For example, the sensing clock signal SENSE_CLK has a plurality of pulses or a plurality of cycles within the active period of each scan signal (or each carry signal), and an M-th sensing driving unit 220 of the first through N-th sensing driving units 220 and 240 can activate an M-th sensing signal SSENSE(M) a plurality of times during an active period of an (M+1)-th scan signal SSCAN(M+1) based on the pulses of the sensing clock signal SENSE_CLK, where M is an integer greater than 0 and less than N. In some example embodiments, the sensing clock signal SENSE_CLK has, within the active period of each scan signal (or each carry signal), a clock active period during which the sensing clock signal SENSE_CLK has a plurality of pulses or a plurality of cycles. A clock inactive period during which the sensing clock signal SENSE_CLK is inactivated, and the M-th sensing driving unit 220 can activate the M-th sensing signal SSENSE(M) a plurality of times during the clock active period of the sensing clock signal SENSE_CLK within the active period of the (M+1)-th scan signal SSCAN (M+1) based on the pulses of the sensing clock signal SENSE_CLK.

Figure 2:
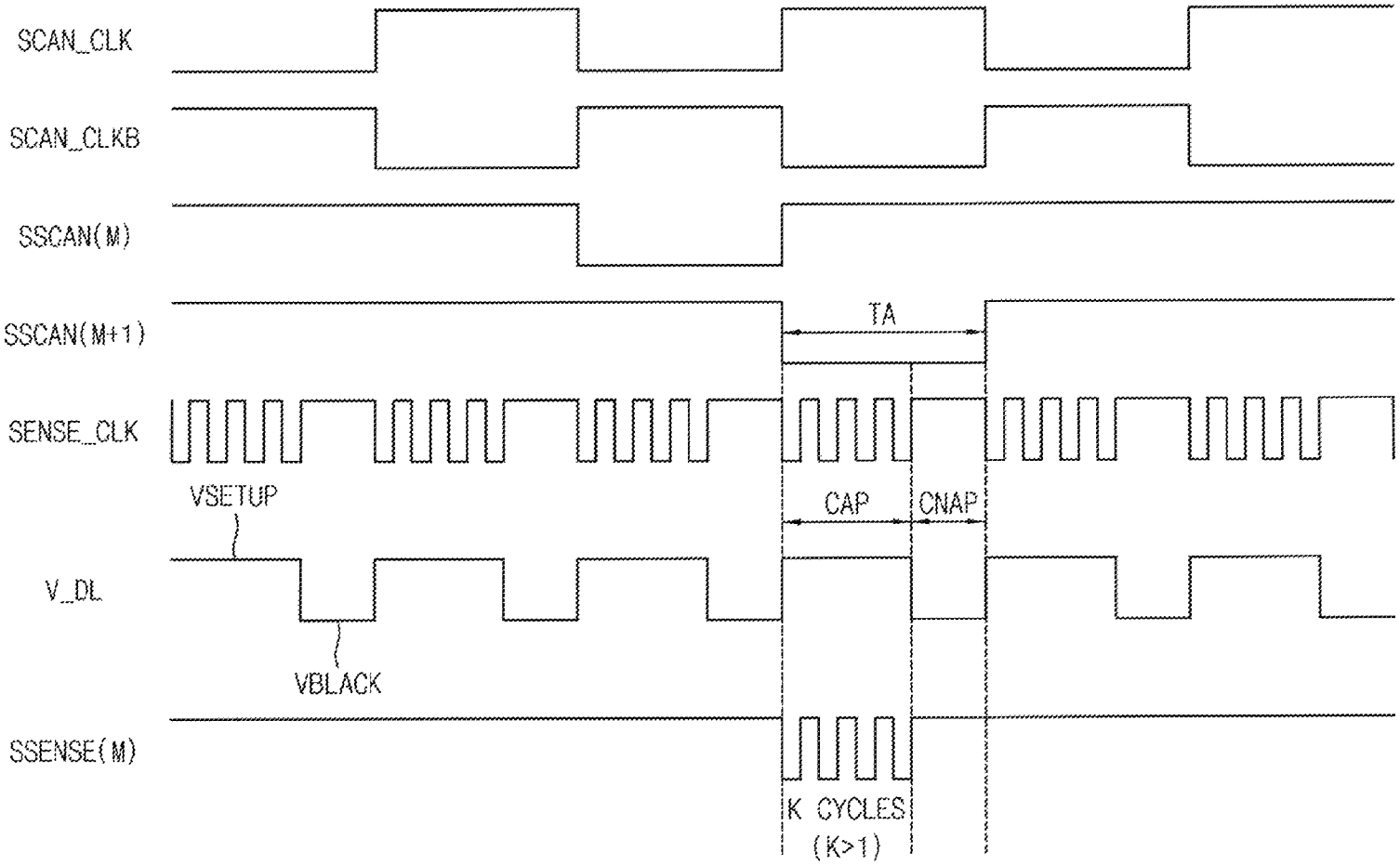
FIG. 2 is a timing diagram for describing an operation of a gate driver of FIG. 1.

For example, as illustrated in FIG. 2, an M-th scan signal SSCAN(M) is active while the scan clock signal SCAN_CLK has the low level, and then the (M+1)-th scan signal SSCAN(M+1) is active while the inverted scan clock signal SCAN_CLKB has the low level. The sensing clock signal SENSE_CLK can have, within each low period of the scan clock signal SCAN_CLK or each low period of the inverted scan clock signal SCAN_CLKB, the clock active period CAP during which the sensing clock signal SENSE_CLK has the pulses or the cycles, and the clock inactive period CNAP during which the sensing clock signal SENSE_CLK is inactivated. During each clock active period CAP of the sensing clock signal SENSE_CLK, the sensing clock signal SENSE_CLK can have a period shorter than a period of the scan clock signal SCAN_CLK, and can have K pulses or K cycles, where K is an integer greater than 1. The M-th sensing driving unit 220 can iteratively activate the M-th sensing signal SSENSE(M) K times in response to the K pulses of the sensing clock signal SENSE_CLK during the active period TA of the (M+1)-th scan signal SSCAN(M+1) (or during the clock active period CAP of the sensing clock signal SENSE_CLK within the active period TA of the (M+1)-th scan signal SSCAN(M+1)).

A deterioration degree of the OLED can be measured K times based on the M-th sensing signal SSENSE(M) that is iteratively activated K times. For example, in the sensing mode, the M-th sensing signal SSENSE(M) applied to a pixel PX coupled to an M-th scan line and an M-th sensing line is iteratively activated K times, and a setup voltage VSETUP can be applied as a data line voltage V_DL to the data line DL. The sensing transistor TSE included in the pixel PX can transfer the setup voltage VSETUP applied to the data line DL to the OLED (e.g., an anode electrode of the OLED) in response to the M-th sensing signal SSENSE(M) that is iteratively activated K times. At this time, a current flowing through the OLED by the setup voltage VSETUP can be measured. Since the M-th sensing signal SSENSE (M) is iteratively activated a plurality of times or has a plurality of pulses during the active period TA of the (M+1)-th scan signal SSCAN(M+1) (or during the clock active period CAP of the sensing clock signal SENSE_CLK within the active period TA of the (M+1)-th scan signal SSCAN(M+1)), the current flowing through the OLED by the setup voltage VSETUP can be measured a plurality of times in response to the pulses of the M-th sensing signal SSENSE(M) during the active period TA of the (M+1)-th scan signal SSCAN(M+1) (or during the clock active period CAP of the sensing clock signal SENSE_CLK within the active period TA of the (M+1)-th scan signal SSCAN(M+1)). Deterioration data representing the deterioration degree of the OLED can be generated based on the measured current (e.g., based on an average of the current measured), and, in the normal operating mode, input image data for the pixel PX can be adjusted based on the deterioration data to compensate the deterioration of the OLED. In some embodiments, the display device can include a calculator (not shown) that can calculate the average of the measured currents. Accordingly, since the current flowing through the OLED by the setup voltage VSETUP is measured the plurality of times, the deterioration degree of the OLED can be more accurately measured compared to a typical sensing method where the current flowing through the OLED is measured only once. Further, if the current flowing through the OLED is measured once in each frame with respect to all pixels PX, and is measured a plurality of times during a plurality of frames, a memory should have a size corresponding to a product of the number of all pixels PX and the number of frames. However, in the display device 200 according to example embodiments, since the current flowing through the OLED is iteratively (or successively) measured the plurality of times with respect to the pixels PX located at each row, the size of the memory for storing measured data can be reduced from the size corresponding to the number of all pixels PX to the size corresponding to the number of the pixels PX in one row.

During the clock inactive period CNAP of the sensing clock signal SENSE_CLK within the active period TA of the (M+1)-th scan signal SSCAN(M+1), a black gray-level voltage VBLACK (e.g., a lowest gray-level voltage) can be stored in the storage capacitor CST of the pixel PX coupled to an (M+1)-th scan line and an (M+1)-th sensing line. For example, during the clock inactive period CNAP within the active period TA of the (M+1)-th scan signal SSCAN(M+1), the black gray-level voltage VBLACK is applied as the data line voltage V_DL to the data line DL, the switching transistor TSW of the pixel PX coupled to the (M+1)-th scan line and the (M+1)-th sensing line can store the black gray-level voltage VBLACK in the storage capacitor CST in response to the (M+1)-th scan signal SSCAN(M+1). Thus, in some embodiments, while a sensing operation for the pixel PX coupled to the (M+1)-th scan line and the (M+1)-th sensing line is performed, or during the clock active period CAP within an active period TA of an (M+2)-th scan signal, the driving transistor TDR of the pixel PX coupled to the (M+1)-th scan line and the (M+1)-th sensing line can be turned off based on the black gray-level voltage VBLACK stored in the storage capacitor CST, and thus a current path from a high power supply voltage ELVDD through the driving transistor TDR and the OLED to a low power supply voltage ELVSS is not formed in the pixel PX coupled to the (M+1)-th scan line and the (M+1)-th sensing line. Accordingly, since, during the active period TA of the (M+2)-th scan signal, only the current generated by the setup voltage VSETUP applied through the data line DL and the sensing transistor TSE can flow through the OLED in the pixel PX coupled to the (M+1)-th scan line and the (M+1)-th sensing line, the deterioration degree of the OLED of the pixel PX can be accurately measured.

In some example embodiments, the setup voltage VSETUP has a voltage level different from a voltage level of the black gray-level voltage VBLACK. Further, in some example embodiments, the setup voltage VSETUP has a plurality of voltage levels, and a plurality of sensing operations are performed with respect to each pixel PX by using the setup voltage VSETUP having the voltage levels. For example, a sensing operation is performed during one frame by using the setup voltage VSETUP having one of the voltage levels, and another sensing operation is performed during the next frame by using the setup voltage VSETUP having another one of the voltage levels.

In other example embodiments, the setup voltage VSETUP has a voltage level substantially the same as a voltage level of the black gray-level voltage VBLACK. In this case, in some example embodiments, the sensing clock signal SENSE_CLK has only the clock active period CAP without the clock inactive period CNAP, and has successive pulses. Further, in this case, with respect to the pixel PX coupled to the M-th scan line and the M-th sensing line, the black gray-level voltage VBLACK (or the setup voltage VSETUP) can be stored in the storage capacitor CST through the switching transistor TSW during the active period of the M-th scan signal. Thus, during the active period TA of the (M+1)-th scan signal, or while the sensing operation for the pixel PX coupled to the M-th scan line and the M-th sensing line is performed, the driving transistor TDR can be turned off based on the black gray-level voltage VBLACK stored in the storage capacitor CST.

In still other example embodiments, each pixel PX further includes the emission transistor TEM that selectively couples the driving transistor TDR to the OLED in response to the emission signal SEM. In this case, in some example embodiments, the sensing clock signal SENSE_CLK has only the clock active period CAP without the clock inactive period CNAP, and has successive pulses. In the sensing mode, the emission signal SEM can have a high level, and the emission transistor TEM can be turned off in response to the emission signal SEM having the high level. Thus, in some embodiments, in the sensing mode, a current path from the high power supply voltage ELVDD through the driving transistor TDR and the OLED to the low power supply voltage ELVSS is not formed. In this case, the setup voltage VSETUP applied through the data line DL and the sensing transistor TSE to the OLED has at least one voltage level corresponding to at least one gray-level. In some example embodiments, the setup voltage VSETUP having a plurality of voltage levels is used to improve the accuracy of the deterioration measurement for the OLED.

In still other example embodiments, in the sensing mode, a current measuring line separate from the data line DL to which the black gray-level voltage VBLACK is applied can be coupled to the pixels at each column, and the setup voltage VSETUP can be applied to the OLED through the current measuring line and the sensing transistor TSE. Accordingly, in some embodiments, in the sensing mode, the driving transistor TDR can be turned off based on the black gray-level voltage VBLACK applied through the data line DL, and thus a current path from the high power supply voltage ELVDD through the driving transistor TDR and the OLED to the low power supply voltage ELVSS is not formed. The setup voltage VSETUP applied through the current measuring line and the sensing transistor TSE to the OLED can have at least one voltage level corresponding to at least one gray-level.

As described above, the gate driver 200 according to example embodiments can iteratively (or successively) activate each sensing signal SSENSE(M) during the active period of the corresponding scan signal SSCAN(M+1) (e.g., during the active period of the scan signal SSCAN(M+1) of the next stage). Accordingly, compared with the method where the current flowing through the OLED is measured once, the deterioration degree of the OLED can be more accurately measured, and the deterioration of the OLED can be more accurately compensated. Further, the sensing operation for the pixels PX at each row can be iteratively (or successively) performed a plurality of times during the active period of the corresponding scan signal, and thus the size of the memory for storing measured data for the current flowing through the OLED can be reduced.

Figure 3:
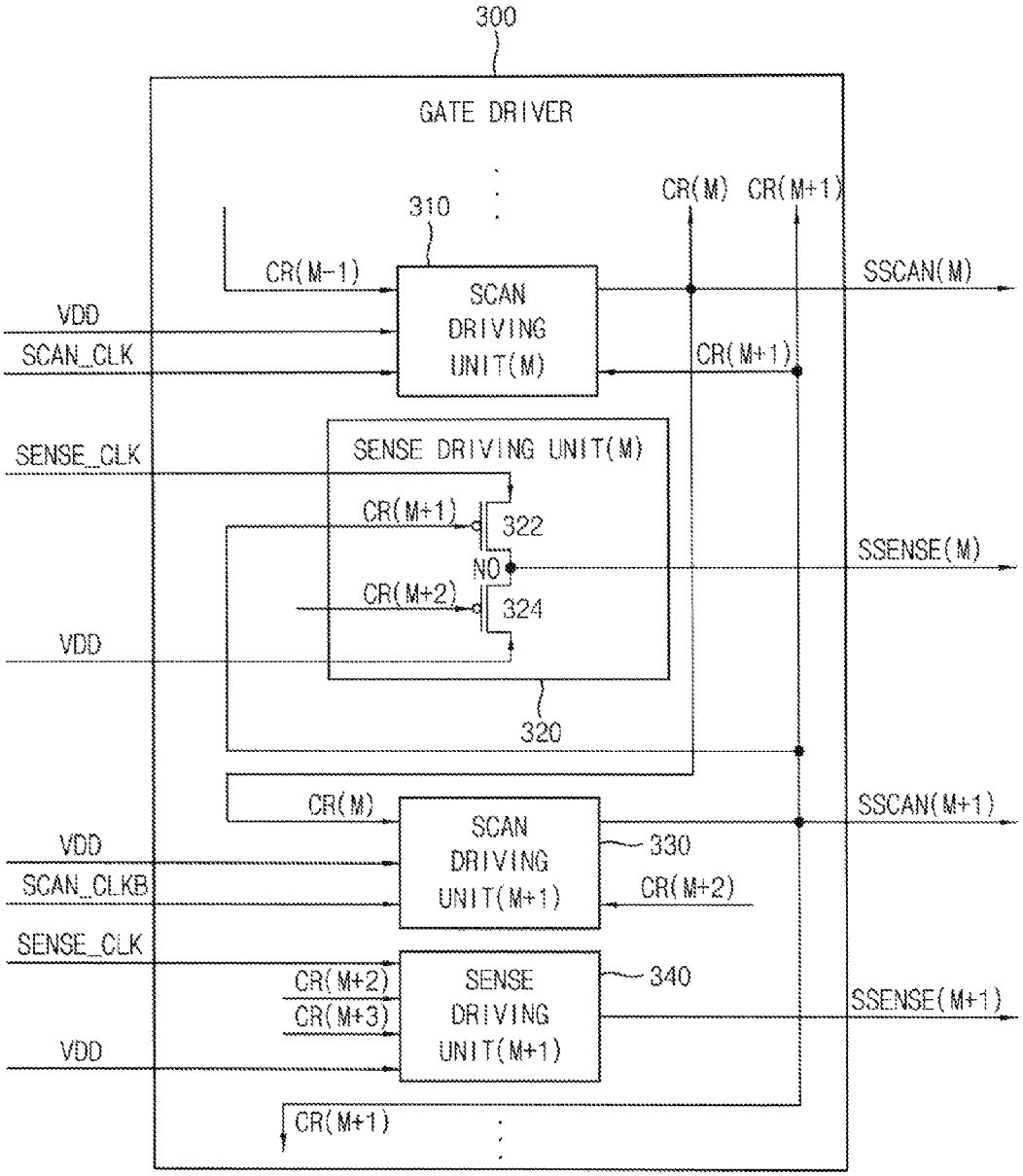
FIG. 3 is a diagram illustrating the gate driver according to example embodiments.

FIG. 3 is a diagram illustrating a gate driver according to example embodiments.

Referring to FIG. 3, a gate driver 300 includes first through N-th scan driving units 310 and 330 that respectively output first through N-th scan signals SSCAN(M) and SSCAN(M+1), and first through N-th sensing driving units 320 and 340 that respectively output first through N-th sensing signals SSENSE(M) and SSENSE(M+1).

In some example embodiments, the first through N-th scan driving units 310 and 330 and the first through N-th sensing driving units 320 and 340 are directly formed on a peripheral region of a display panel. For example, transistors 322 and 324 included in the first through N-th scan driving units 310 and 330 and the first through N-th sensing driving units 320 and 340 are directly formed on a substrate of the display panel, and the gate driver 300 is an embedded gate driver that is embedded in the display panel. Further, in some example embodiments, the first through N-th scan driving units 310 and 330 and the first through N-th sensing driving units 320 and 340 are alternately disposed. For example, as illustrated in FIG. 3, M-th and (M+1)-th scan driving units 310 and 330 and M-th and (M+1)-th sensing driving units 320 and 340 are formed in an order of the M-th scan driving unit 310, the M-th sensing driving unit 320, the (M+1)-th scan driving unit 330 and the (M+1)-th sensing driving unit 340.

The first through N-th scan driving units 310 and 330 can sequentially output the first through N-th scan signals SSCAN(M) and SSCAN(M+1) based on a power supply voltage VDD and a scan clock signal SCAN_CLK and SCAN_CLKB. Each scan driving unit 310 and 330 can activate a corresponding scan signal in response to a carry signal of a previous scan driving unit. For example, the M-th sensing driving unit 320 activates an M-th scan signal SSCAN(M) in response to an (M−1)-th carry signal CR(M−1), and the (M+1)-th scan driving unit 330 activates an (M+1)-th scan signal SSCAN(M+1) in response to an M-th carry signal CR(M). According to example embodiments, the scan signals SSCAN(M) and SSCAN(M+1) of each scan driving unit 310 and 330 are used as the carry signal CR(M−1), CR(M), CR(M+1), CR(M+2) and CR(M+3), or each scan driving unit 310 and 330 additionally generate the carry signal CR(M−1), CR(M), CR(M+1), CR(M+2) and CR(M+3) having substantially the same level as the scan signal SSCAN(M) and SSCAN(M+1). In some example embodiments, each scan driving unit 310 and 330 inactivates the scan signal SSCAN(M) and SSCAN(M+1) in response to the carry signal CR(M−1), CR(M), CR(M+1), CR(M+2) and CR(M+3) of the next scan driving unit. For example, the M-th scan driving unit 310 inactivates the M-th scan signal SSCAN(M) in response to the carry signal (i.e., the (M+1)-th carry signal CR(M+1)) of the next scan driving unit (i.e., the (M+1)-th scan driving unit 330), and the (M+1)-th scan driving unit 330 inactivates the carry signal (i.e., the (M+2)-th carry signal CR(M+2)) of the next scan driving unit.

Each sensing driving unit 320 and 340 can iteratively (or successively) activate the sensing signal SSENSE(M) and SSENSE(M+1) based on the power supply voltage VDD and a sensing clock signal SENSE_CLK. For example, the M-th sensing driving unit 320 activates the M-th sensing signal SSENSE(M) a plurality of times during an active period of the (M+1)-th scan signal SSCAN(M+1) (or during a clock active period of the sensing clock signal SENSE_CLK within the active period of the (M+1)-th scan signal SSCAN(M+1)), and the (M+1)-th sensing driving unit 340 activates the (M+1)-th sensing signal SSENSE(M+1) a plurality of times during an active period of an (M+2)-th scan signal (or during the clock active period of the sensing clock signal SENSE_CLK within the active period of the (M+2)-th scan signal). To perform this operation, each sensing driving unit 320 and 340 can include a plurality of transistors 322 and 324.

For example, the M-th sensing driving unit 320 includes a first transistor 322 that outputs the sensing clock signal SENSE_CLK as the M-th sensing signal SSENSE(M) during an active period of the (M+1)-th carry signal CR(M+1) (or the (M+1)-th scan signal SSCAN(M+1)) in response to the (M+1)-th carry signal CR(M+1) output from the (M+1)-th scan driving unit 330, and a second transistor 324 that outputs the power supply voltage VDD as the M-th sensing signal SSENSE(M) during an active period of the (M+2)-th carry signal CR(M+2) (or the (M+2)-th scan signal) in response to the (M+2)-th carry signal CR(M+2) output from an (M+2)-th scan driving unit. In some example embodiments, the first transistor 322 is a first PMOS transistor 322 having a first terminal receiving the sensing clock signal SENSE_CLK, a second terminal coupled to an output node NO of the M-th sensing driving unit 320, and a first gate terminal receiving the (M+1)-th carry signal CR(M+1). The second transistor 324 can be a second PMOS transistor 324 having a third terminal coupled to the output node NO of the M-th sensing driving unit 320, a fourth terminal receiving the power supply voltage VDD, and a second gate terminal receiving the (M+2)-th carry signal CR(M+2).

The sensing clock signal SENSE_CLK can have a plurality of pulses during the active period of the (M+1)-th carry signal CR(M+1) (or the (M+1)-th scan signal SSCAN (M+1)) (or during the clock active period of the sensing clock signal SENSE_CLK within the active period of the (M+1)-th carry signal CR(M+1) (or the (M+1)-th scan signal SSCAN(M+1))). Thus, during the active period of the (M+1)-th carry signal CR(M+1) (or the (M+1)-th scan signal SSCAN(M+1)), the M-th sensing signal SSENSE(M) can be activated a plurality of times. Since the sensing signal (e.g., the M-th sensing signal SSENSE(M)) is iteratively (or successively) activated and applied the plurality of times to pixels in one row (e.g., pixels coupled to an M-th scan line and an M-th sensing line), currents flowing though OLEDs included in the pixels can be iteratively (or successively) measured. Accordingly, accuracy of deterioration measurement can be improved, and a size of a memory for storing measured data can be reduced.

Figure 4:
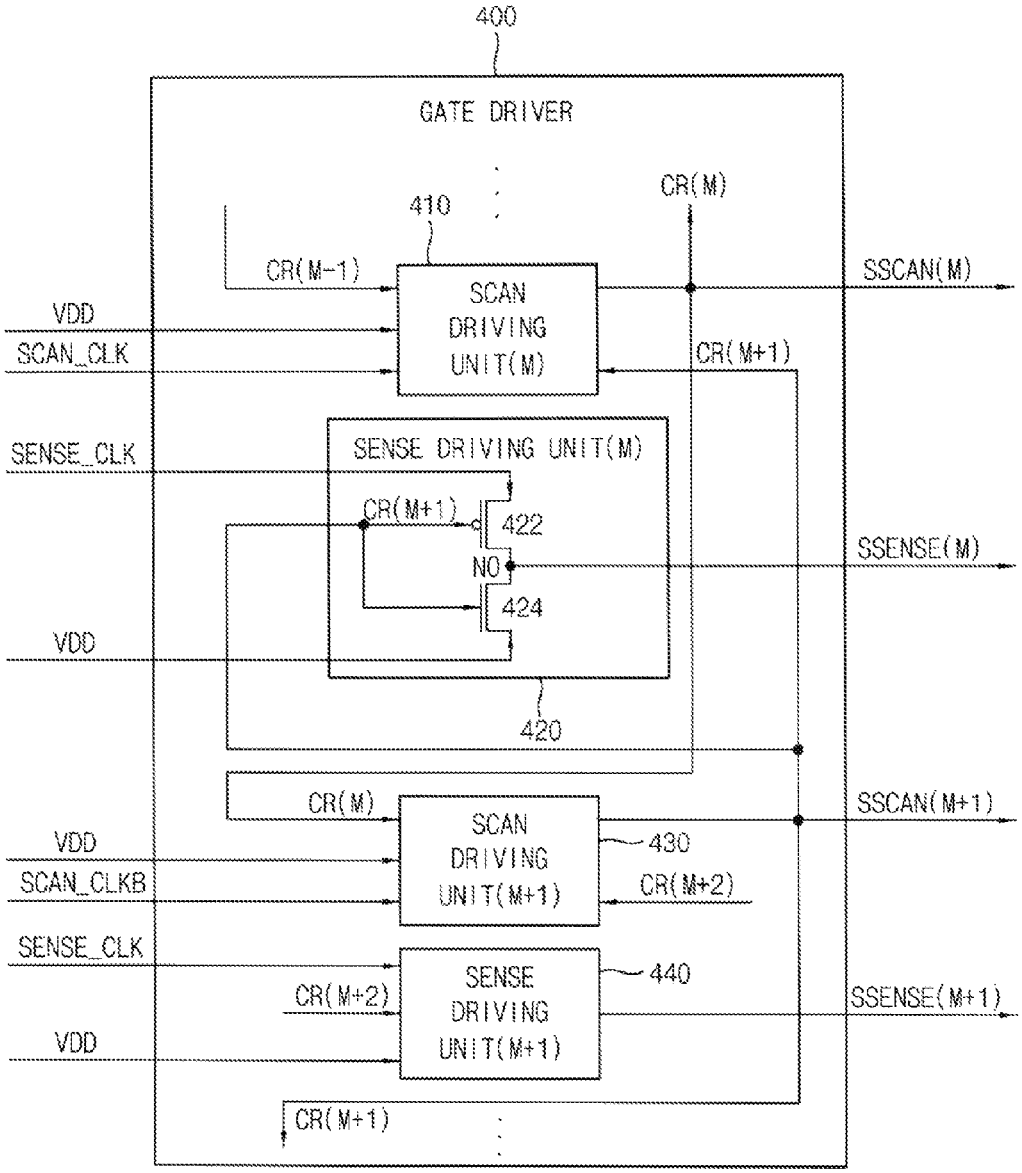
FIG. 4 is a diagram illustrating a gate driver according to example embodiments.

FIG. 4 is a diagram illustrating a gate driver according to example embodiments.

Referring to FIG. 4, a gate driver 400 includes first through N-th scan driving units 410 and 430 that respectively output first through N-th scan signals SSCAN(M) and SSCAN(M+1), and first through N-th sensing driving units 420 and 440 that respectively output first through N-th sensing signals SSENSE(M) and SSENSE(M+1). The gate driver 400 of FIG. 4 can have a similar configuration to a gate driver 300 of FIG. 3, except for a configuration of each sensing driving unit 420 and 440.

Each sensing driving unit 420 and 440 can iteratively (or successively) activate the sensing signal SSENSE(M) and SSENSE(M+1) based on a power supply voltage VDD and a sensing clock signal SENSE_CLK. For example, an M-th sensing driving unit 420 includes a first transistor 422 that outputs the sensing clock signal SENSE_CLK as an M-th sensing signal SSENSE(M) during an active period of an (M+1)-th carry signal CR(M+1) in response to the (M+1)-th carry signal CR(M+1) output from an (M+1)-th scan driving unit 430, and a second transistor 424 that outputs the power supply voltage VDD as the M-th sensing signal SSENSE(M) during an inactive period of the (M+1)-th carry signal CR(M+1) in response to the (M+1)-th carry signal CR(M+1). In some example embodiments, the first transistor 422 is a PMOS transistor 422 having a first terminal receiving the sensing clock signal SENSE_CLK, a second terminal coupled to an output node NO of the M-th sensing driving unit 420, and a first gate terminal receiving the (M+1)-th carry signal CR(M+1). The second transistor 424 can be an NMOS transistor 424 having a third terminal coupled to the output node NO of the M-th sensing driving unit 420, a fourth terminal receiving the power supply voltage VDD, and a second gate terminal receiving the (M+1)-th carry signal CR(M+1).

The sensing clock signal SENSE_CLK can have a plurality of pulses during the active period of the (M+1)-th carry signal CR(M+1) (or during the clock active period of the sensing clock signal SENSE_CLK within the active period of the (M+1)-th carry signal CR(M+1)). Thus, during the active period of the (M+1)-th carry signal CR(M+1), the M-th sensing signal SSENSE(M) can be activated a plurality of times. Since the sensing signal (e.g., the M-th sensing signal SSENSE(M)) is iteratively (or successively) activated and applied the plurality of times to pixels in one row (e.g., pixels coupled to an M-th scan line and an M-th sensing line), currents flowing though OLEDs included in the pixels can be iteratively (or successively) measured. Accordingly, accuracy of deterioration measurement can be improved, and a size of a memory for storing measured data can be reduced.

Figure 5:
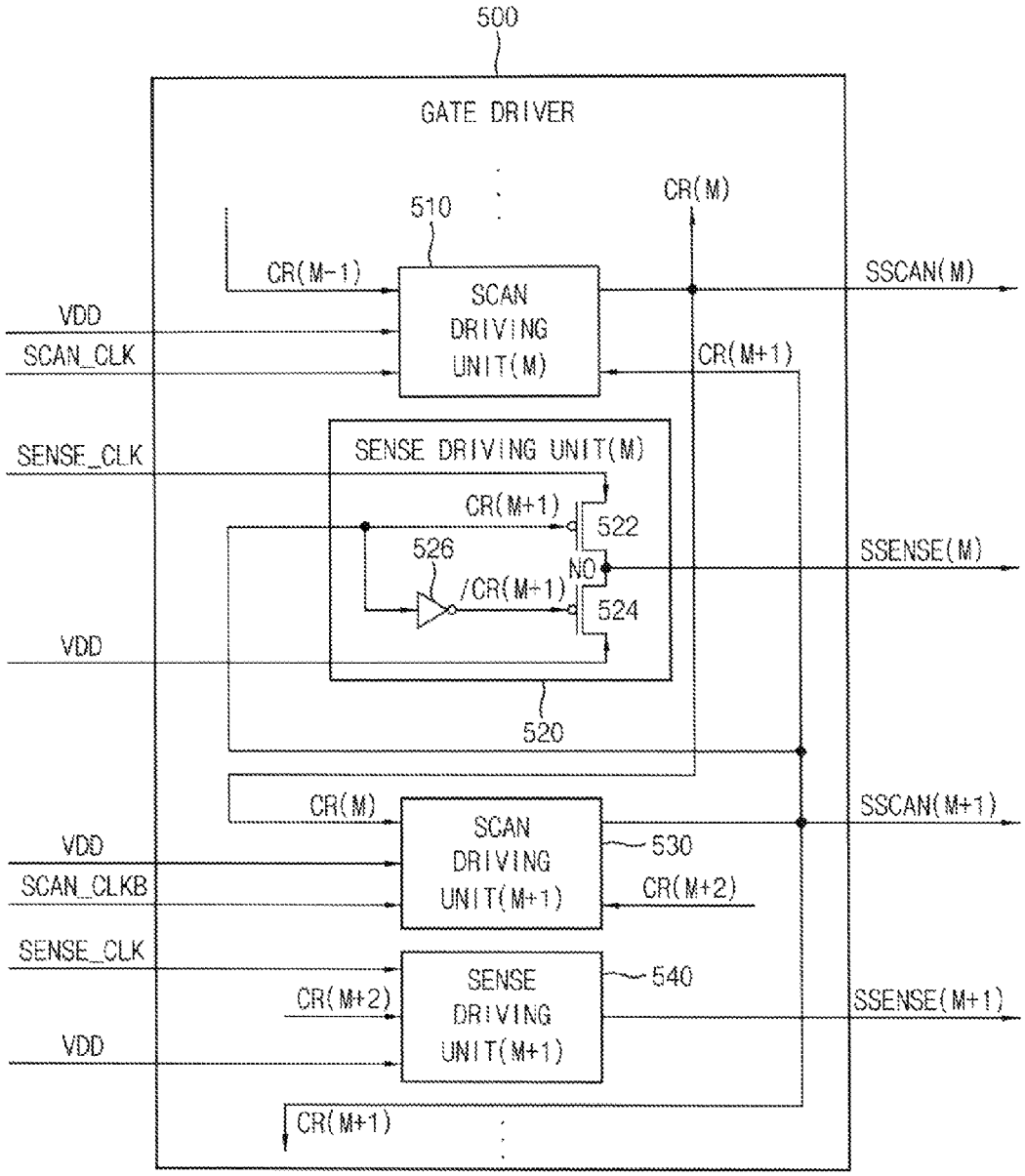
FIG. 5 is a diagram illustrating a gate driver according to example embodiments.

FIG. 5 is a diagram illustrating a gate driver according to example embodiments.

Referring to FIG. 5, a gate driver 500 includes first through N-th scan driving units 510 and 530 that respectively output first through N-th scan signals SSCAN(M) and SSCAN(M+1), and first through N-th sensing driving units 520 and 540 that respectively output first through N-th sensing signals SSENSE(M) and SSENSE(M+1). The gate driver 500 of FIG. 5 has a similar configuration to a gate driver 300 of FIG. 3, except for a configuration of each sensing driving unit 520 and 540.

Each sensing driving unit 520 and 540 can iteratively (or successively) activate the sensing signal SSENSE(M) and SSENSE(M+1) based on a power supply voltage VDD and a sensing clock signal SENSE_CLK. For example, an M-th sensing driving unit 520 includes a first transistor 522 that outputs the sensing clock signal SENSE_CLK as an M-th sensing signal SSENSE(M) during an active period of an (M+1)-th carry signal CR(M+1) in response to the (M+1)-th carry signal CR(M+1) output from an (M+1)-th scan driving unit 530. The M-th sensing driving unit 520 can also include an inverter 526 that generates an inverted (M+1)-th carry signal /CR(M+1) by inverting the (M+1)-th carry signal CR(M+1) output from the (M+1)-th scan driving unit 530, and a second transistor 524 that outputs the power supply voltage VDD as the M-th sensing signal SSENSE(M) during an inactive period of the (M+1)-th carry signal CR(M+1) (or during an active period of the inverted (M+1)-th carry signal /CR(M+1)) in response to the inverted (M+1)-th carry signal /CR(M+1). In some example embodiments, the first transistor 522 is a first PMOS transistor 522 having a first terminal receiving the sensing clock signal SENSE_CLK, a second terminal coupled to an output node NO of the M-th sensing driving unit 520, and a first gate terminal receiving the (M+1)-th carry signal CR(M+1). The second transistor 524 can be a second PMOS transistor 524 having a third terminal coupled to the output node NO of the M-th sensing driving unit 520, a fourth terminal receiving the power supply voltage VDD, and a second gate terminal receiving inverted (M+1)-th carry signal /CR(M+1).

The sensing clock signal SENSE_CLK can have a plurality of pulses during the active period of the (M+1)-th carry signal CR(M+1) (or during the clock active period of the sensing clock signal SENSE_CLK within the active period of the (M+1)-th carry signal CR(M+1)). Thus, during the active period of the (M+1)-th carry signal CR(M+1), the M-th sensing signal SSENSE(M) can be activated a plurality of times. Since the sensing signal (e.g., the M-th sensing signal SSENSE(M)) is iteratively (or successively) activated and applied the plurality of times to pixels in one row (e.g., pixels coupled to an M-th scan line and an M-th sensing line), currents flowing though OLEDs included in the pixels can be iteratively (or successively) measured. Accordingly, accuracy of deterioration measurement can be improved, and a size of a memory for storing measured data can be reduced.

Figure 6:
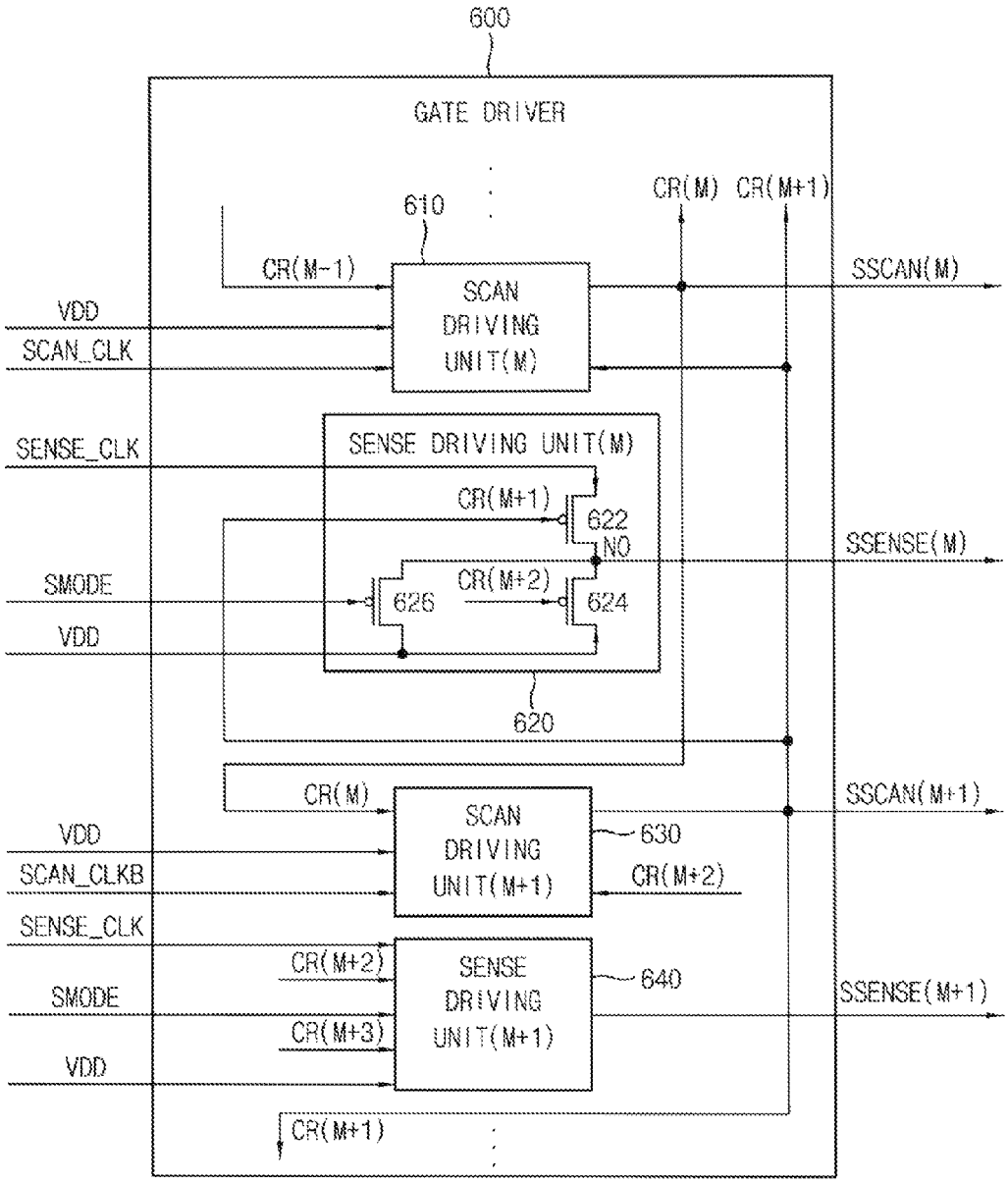
FIG. 6 is a diagram illustrating a gate driver according to example embodiments.

FIG. 6 is a diagram illustrating a gate driver according to example embodiments.

Referring to FIG. 6, a gate driver 600 includes first through N-th scan driving units 610 and 630 that respectively output first through N-th scan signals SSCAN(M) and SSCAN(M+1), and first through N-th sensing driving units 620 and 640 that respectively output first through N-th sensing signals SSENSE(M) and SSENSE(M+1). The gate driver 600 of FIG. 6 can have a similar configuration to a gate driver 300 of FIG. 3, except for a configuration of each sensing driving unit 620 and 640.

Compared with each sensing driving unit 320 and 340 illustrated in FIG. 3, each sensing driving unit 620 and 640 illustrated in FIG. 6 can further include a mode select transistor 626 coupled between an output node NO and a power supply voltage VDD. The mode select transistor 626 can selectively couple the power supply voltage VDD to the output node NO in response to a mode signal SMODE. For example, in a sensing mode, the mode signal SMODE has a high level, and the mode select transistor 626 is turned off in response to the mode signal SMODE having the high level. In a normal operating mode, the mode signal SMODE can have a low level, and the mode select transistor 626 can be turned on in response to the mode signal SMODE having the low level. Accordingly, in the normal operating mode, each sensing driving unit 620 and 640 can inactivate the sensing signal SSENSE(M) and SSENSE(M+1).

Figure 7:
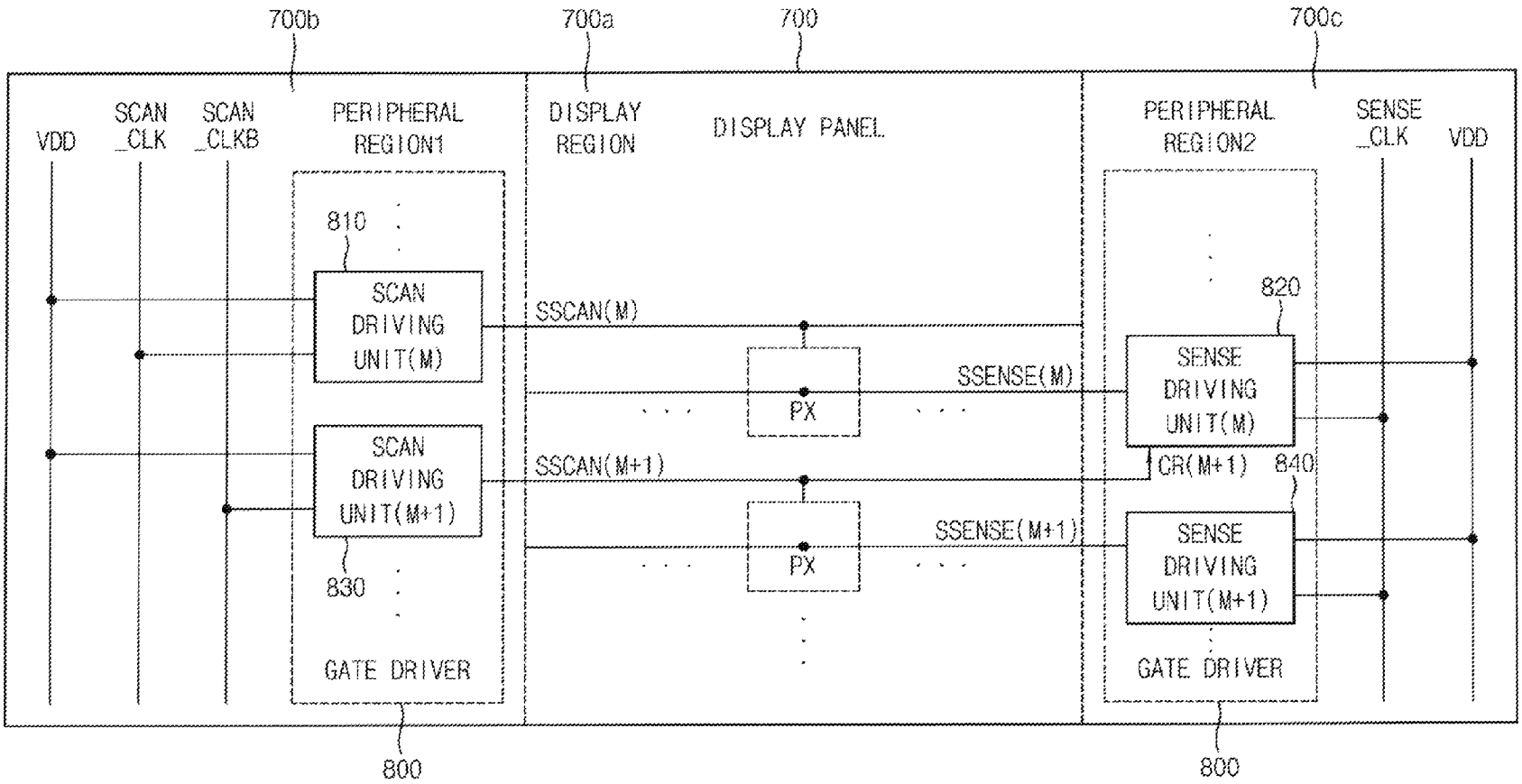
FIG. 7 is a diagram illustrating a display panel including a gate driver according to example embodiments.

FIG. 7 is a diagram illustrating a display panel including a gate driver according to example embodiments.

Referring to FIG. 7, a display panel 700 includes a display region 700*a*, a first peripheral region 700*b* and a second peripheral region 700*c*. In the display region 700*a* of the display panel 700, a plurality of pixels PX is formed.

In the first and second peripheral regions 700*b* and 700*c*, a gate driver 800 that provides first through N-th scan signals SSCAN(M) and SSCAN(M+1) and first through N-th sensing signals SSENSE(M) and SSENSE(M+1) to the pixel PX can be formed. The gate driver 700 can include first through N-th scan driving units 810 and 830 that respectively output first through N-th scan signals SSCAN(M) and SSCAN(M+1), and first through N-th sensing driving units 820 and 840 that respectively output first through N-th sensing signals SSENSE(M) and SSENSE(M+1).

In some example embodiments, the first through N-th scan driving units 810 and 830 are formed on the first peripheral region 700*b* located in a first direction from the display region 700*a*, and the first through N-th sensing driving units 820 and 840 are formed on the second peripheral region 700*c* located in a second direction opposite to the first direction from the display region 700*a*. In this case, each sensing driving unit 820 and 840 can receive the scan signal SSCAN(M) and SSCAN(M+1) applied through a scan line as a carry signal CRM+1. For example, an M-th sensing driving unit 820 receives an (M+1)-th scan signal SSCAN(M+1) as an (M+1)-th carry signal CRM+1 through an (M+1)-th scan line, and activates an M-th sensing signal SSENSE(M) a plurality of times during an active period of the (M+1)-th carry signal CRM+1 (or during an clock active period of a sensing clock signal SENSE_CLK within the active period of the (M+1)-th carry signal CRM+1).

As described above, since the sensing signal (e.g., the M-th sensing signal SSENSE(M)) is iteratively (or successively) activated and applied the plurality of times to pixels PX in one row (e.g., the pixels PX coupled to an M-th scan line and an M-th sensing line), currents flowing though OLEDs included in the pixels can be iteratively (or successively) measured. Accordingly, accuracy of deterioration measurement can be improved, and a size of a memory for storing measured data can be reduced. Further, since the first through N-th scan driving units 810 and 830 are formed on the first peripheral region 700*b* of the display panel 700, and the first through N-th sensing driving units 820 and 840 can be formed on the second peripheral region 700*c* of the display panel 700, a bezel size of the display panel 700 can be reduced.

Figure 8:
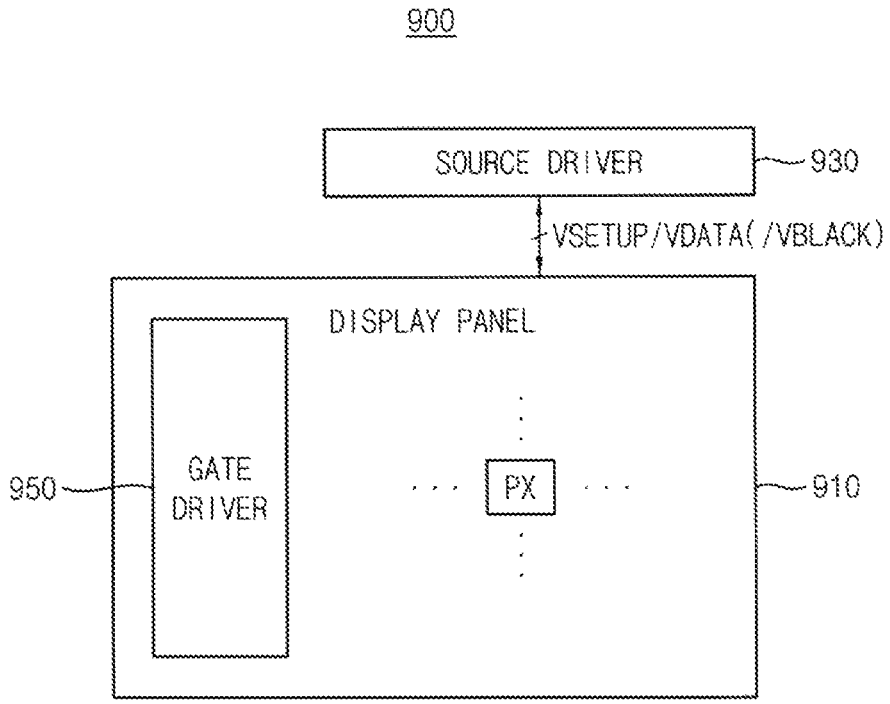
FIG. 8 is a block diagram illustrating a display device according to example embodiments.

FIG. 8 is a block diagram illustrating a display device according to example embodiments.

Referring to FIG. 8, a display device 900 includes a display panel 910 including a plurality of pixels PX, a source driver 930 that provides data signals VDATA to the pixels PX, and a gate driver 950 that provides first through N-th scan signals and first through N-th sensing signals to the pixels PX. In some example embodiments, the gate driver 950 is not implemented as an integrated circuit, and is an embedded gate driver including transistors directly formed on the display panel 910. That is, the gate driver 950 can be embedded in the display panel 910.

In a normal operating mode, the gate driver 950 can sequentially provide the first through N-th scan signals to the pixels PX, and the source driver 930 can provide the data signals VDATA to the pixels PX. The pixels PX can store the data signals VDATA in response to the first through N-th scan signals, and can emit light based on the stored data signals VDATA.

In a sensing mode, the gate driver 950 can provide the first through N-th sensing signals and/or the first through N-th scan signals to the pixels PX, and the source driver 930 can provide a setup voltage VSETUP (and/or a black gray-level voltage VBLACK) to the pixels PX. The gate driver 950 can iteratively (or successively) activate each sensing signal a plurality of times with respect to the pixels PX in each row. For example, gate driver 950 activates an M-th sensing signal the plurality of times during an activate period of an (M+1)-th scan signal. Thus, since the sensing signal for the pixels PX in one row is iteratively (or successively) activated, currents flowing through OLEDs included in the pixels in one row can be iteratively (or successively) measured. Accordingly, accuracy of deterioration measurement can be improved, and a size of a memory for storing measured data can be reduced.

Figure 9:
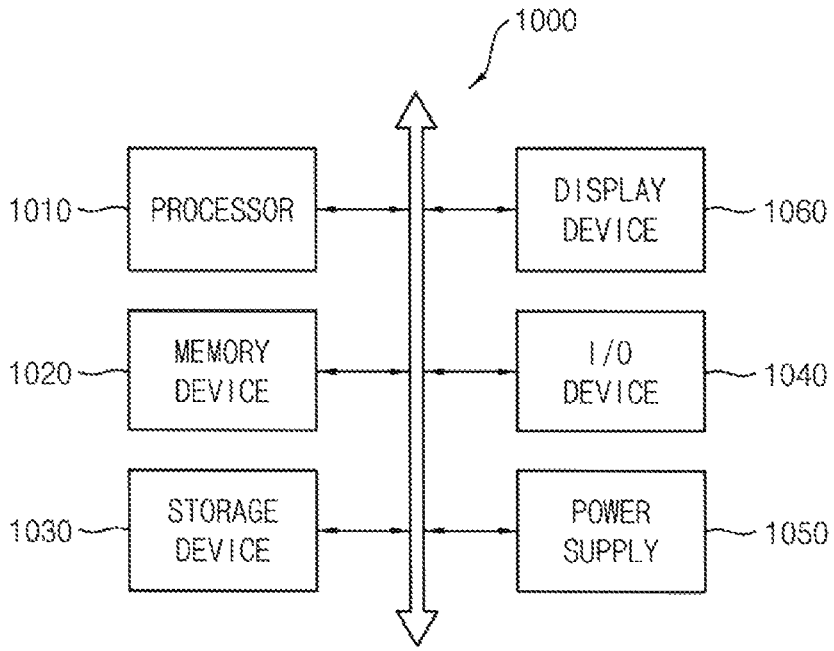
FIG. 9 is a block diagram illustrating an electronic device including a display device according to example embodiments.

FIG. 9 is a block diagram illustrating an electronic device including a display device according to example embodiments.

Referring to FIG. 9, an electronic device 1000 includes a processor 1010, a memory device 1020, a storage device 1030, an input/output (I/O) device 1040, a power supply 1050, and a display device 1060. The electronic device 1000 can further include a plurality of ports for communicating a video card, a sound card, a memory card, a universal serial bus (USB) device, other electric devices, etc.

The processor 1010 can perform various computing functions. The processor 1010 can be a microprocessor, a central processing unit (CPU), an application processor (AP), etc. The processor 1010 can be coupled to other components via an address bus, a control bus, a data bus, etc. Further, in some example embodiments, the processor 1010 is coupled to an extended bus such as a peripheral component interconnection (PCI) bus.

The memory device 1020 can store data for operations of the electronic device 1000. For example, the memory device 1020 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 can be a solid state drive device, a hard disk drive device, a CD-ROM device, etc. The I/O device 1040 can be an input device such as a keyboard, a keypad, a mouse, a touch screen, etc., and an output device such as a printer, a speaker, etc. The power supply 1050 can supply power for operations of the electronic device 1000.

The display device 1060 can iteratively (or successively) activate each sensing signal for pixels in one row, thus can measure currents flowing through OLEDs included in the pixels in one row can be iteratively (or successively). Accordingly, accuracy of deterioration measurement can be improved, and a size of a memory for storing measured data can be reduced.

The described technology can be applied to any electronic device 1000 including the display device 1060. For example, the described technology can be applied to cellular phones, smartphones, tablet computers, wearable devices, personal digital assistants (PDAs), portable multimedia players (PMPs), digital cameras, music players, portable game consoles, navigation systems, digital televisions, 3D televisions, personal computers (PCs), home appliances, laptop computers, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A gate driver for a display device, the gate driver comprising:

first through N-th scan drivers configured to respectively output first through N-th scan signals, where N is an integer greater than 1; and first through N-th sensing drivers configured to respectively output first through N-th sensing signals, wherein an M-th one of the first through N-th sensing drivers is configured to activate an M-th one of the first through N-th sensing signals K times during an active period of (M+1)-th one of the first through N-th scan signals, where M is an integer greater than 0 and less than N and K is an integer greater than 1, wherein the M-th sensing driver comprises a first transistor configured to output a sensing clock signal as the M-th sensing signal during an active period of an (M+1)-th carry signal based on the (M+1)-th carry signal output from an (M+1)-th one of the first through N-th scan drivers, and wherein the first transistor is a first PMOS transistor including a first terminal configured to receive the sensing clock signal, a second terminal electrically connected to an output node of the M-th sensing driver, and a first gate terminal configured to receive the (M+1)-th carry signal.

2. The gate driver of claim 1, wherein the gate driver is embedded in a display panel of the display device.

3. The gate driver of claim 1, wherein the M-th sensing driver further comprises:

a second transistor configured to output a power supply voltage as the M-th sensing signal during an active period of an (M+2)-th carry signal based on the (M+2)-th carry signal output from an (M+2)-th one of the first through N-th scan drivers.

4. The gate driver of claim 3, wherein the sensing clock signal includes a plurality of pulses within the active period of the (M+1)-th carry signal.

5. The gate driver of claim 3, wherein the sensing clock signal includes a clock-active period and a clock-inactive period during the active period of the (M+1)-th carry signal, and wherein the sensing clock signal includes a plurality of pulses within the clock-active period.

6. The gate driver of claim 3, wherein the second transistor is a second PMOS transistor including a third terminal electrically connected to the output node of the M-th sensing driver, a fourth terminal configured to receive the power supply voltage, and a second gate terminal configured to receive the (M+2)-th carry signal.

7. The gate driver of claim 1, wherein the M-th sensing driver further comprises:

a second transistor configured to output a power supply voltage as the M-th sensing signal during an inactive period of the (M+1)-th carry signal based on the (M+1)-th carry signal.

8. The gate driver of claim 7, wherein the second transistor is an NMOS transistor including a third terminal electrically connected to the output node of the M-th sensing driver, a fourth terminal configured to receive the power supply voltage, and a second gate terminal configured to receive the (M+1)-th carry signal.

9. The gate driver of claim 1, wherein the M-th sensing driver further comprises:

an inverter configured invert the (M+1)-th carry signal so as to generate an inverted (M+1)-th carry signal; and a second transistor configured to output a power supply voltage as the M-th sensing signal during an inactive period of the (M+1)-th carry signal based on the inverted (M+1)-th carry signal.

10. The gate driver of claim 9, wherein the second transistor is a second PMOS transistor including a third terminal electrically connected to the output node of the M-th sensing driver, a fourth terminal configured to receive the power supply voltage, and a second gate terminal configured to receive the inverted (M+1)-th carry signal.

11. The gate driver of claim 1, wherein the first through N-th scan drivers and the first through N-th sensing drivers are formed in a peripheral region of a display panel included in the display device.

12. The gate driver of claim 11, wherein the first through N-th scan drivers and the first through N-th sensing drivers are alternately formed.

13. The gate driver of claim 1, wherein the first through N-th scan drivers are formed in a first peripheral region located on a first side of a display region of a display panel included in the display device, and wherein the first through N-th sensing drivers are formed in a second peripheral region located on a second side opposite to the first side in the display region.

14. The gate driver of claim 1, wherein the first through N-th sensing drivers are further configured to output the first through N-th sensing signals in a sensing mode.

15. A display device, comprising:

a display panel including a plurality of pixels;

a source driver configured to provide a plurality of data signals to the pixels; and a gate driver configured to provide first through N-th scan signals and first through N-th sensing signals to the pixels, where N is an integer greater than 1, wherein the gate driver includes:

first through N-th scan drivers configured to respectively output the first through N-th scan signals through first through N-th scan lines; and first through N-th sensing drivers configured to respectively output the first through N-th sensing signals through first through N-th sensing lines, wherein an M-th one of the first through N-th sensing drivers is further configured to activate an M-th one of the first through N-th sensing signals K times during an active period of an (M+1)-th one of the first through N-th scan signals, where M is an integer greater than 0 and less than N and K is an integer greater than 1, wherein the M-th sensing driver comprises a first transistor configured to output a sensing clock signal as the M-th sensing signal during an active period of an (M+1)-th carry signal based on the (M+1)-th carry signal output from an (M+1)-th one of the first through N-th scan drivers, and wherein the first transistor is a first PMOS transistor including a first terminal configured to receive the sensing clock signal, a second terminal electrically connected to an output node of the M-th sensing driver, and a first gate terminal configured to receive the (M+1)-th carry signal.

16. The display device of claim 15, wherein the gate driver is embedded in the display panel.

17. The display device of claim 15, wherein the source driver is further configured to provide one of the data signals to the pixels as a voltage applied via a data line, wherein a selected one of the pixels electrically connected to an M-th one of the first through N-th scan lines and an M-th one of the first through N-th sensing lines includes:

a switching transistor configured to transfer the applied voltage based on an M-th one of the first through N-th scan signals;

a storage capacitor configured to store the transferred voltage;

a driving transistor configured to generate a driving current based on the stored voltage;

an organic light-emitting diode (OLED) configured to emit light based on the driving current; and a sensing transistor configured to electrically connect the data line to the OLED based on the M-th sensing signal.

18. The display device of claim 17, wherein, in a sensing mode, the source driver is configured to apply a setup voltage to the data line such that the setup voltage of the data line is applied to the OLED through the sensing transistor so as to measure a current flowing through the OLED.

19. The display device of claim 18, wherein the M-th sensing signal includes a plurality of pulses within the (M+1)-th active period, and wherein the current flowing through the OLED is further configured to be measured K times during the (M+1)-th active period.

20. The display device of claim 19, further comprising a calculator configured to calculate an average current amount of the current measured K times, wherein the calculator is configured to generate deterioration data corresponding to a deterioration degree of the OLED based on the average current amount, and wherein, in a normal operating mode, the source driver is further configured to adjust the input image data for the selected pixel based on the deterioration data.

* * * * *